United States Patent [19]

Redmond

[11] Patent Number: 4,545,090

[45] Date of Patent: Oct. 8, 1985

[54] GLASS FILLED PLASTIC HINGE

[76] Inventor: Daniel R. Redmond, 6914 Cedar Ridge, Pinellas Park, Fla. 33565

[21] Appl. No.: 653,155

[22] Filed: Sep. 24, 1984

[51] Int. Cl.[4] ..... E05D 5/00

[52] U.S. Cl. ..... 16/385; 16/DIG. 13

[58] Field of Search ..... 16/385, DIG. 13

[56] References Cited

U.S. PATENT DOCUMENTS 3,703,742 11/1972 Konishi ..... 16/385
4,158,902 6/1979 Chernack et al. ..... 16/DIG. 13 X
4,175,315 11/1979 Hayes, Sr. et al. ..... 16/DIG. 13 X

FOREIGN PATENT DOCUMENTS 1014697 12/1965 United Kingdom ..... 16/385
1022636 3/1966 United Kingdom ..... 16/385

*Primary Examiner*—Fred Silverberg
*Attorney, Agent, or Firm*—Ronald E. Smith

[57] ABSTRACT

A plastic hinge made of fifty percent (50%) glass filled plasticized nylon. The hinge includes a hinge pin having a twenty percent (20%) Delron (trademark) composition. The hinge is non-corrosive and thus is suitable for use in environments where the presence of metallic or other corrosive substances is prohibited. The hinge, which is formed by an injection molding process, is strong but not brittle and is not overly abrasive.

1 Claim, 2 Drawing Figures

GLASS FILLED PLASTIC HINGE

BACKGROUND OF THE INVENTION

1. Field of the Invention

This invention relates to hinges, and more specifically relates to hinges of plastic composition.

2. Description of the Prior Art

Door hinges are typically made of metallic materials because metals are strong and long lasting. Metal hinges, however, suffer from several limitations which have inspired inventors to attempt to construct better hinges. Chief among the limitations sought to be overcome is the corrosive aspect of metallic hinges. A metallic hinge performs poorly in the early stages of corrosion and becomes completely inoperable if the corrosion process is not stopped.

Moreover, metallic hings require frequent lubrication and in the absence of the required lubrication begin emitting aggravating noises.

Metallic hinges are also heavy and thus expensive to transport from the place of manufacture to the points of distribution. The consumer pays for the high cost of transportation of metal hinges, of course.

Finally, metallic hinges can generate sparks when struck and some environments must be carefully protected against sparks.

There is a need for a non-corrosive hinge that is strong yet light in weight. There is also a need for a hinge that does not require lubrication and which can be relied upon to not generate sparks when struck.

Attempts have been made by others to build hinges of plastic. Being non-metallic, plastic is not subject to corrosion and can not generate sparks when struck and is thus suitable for use where spark-producing materials are prohibited. Plastic is light in weight and plastic hinges can therefore be transported at reduced shipping costs vis a vis metallic hinges.

Despite the desireability of plastic as a material for hinges, however, earlier efforts to make hinges of plastic have failed. The only plastic hinge ever available to the public, as far as is known to the inventor of the device to be disclosed hereinafter, had to be withdrawn from the marketplace because it lacked the strength and durability to serve as a replacement for metal hinges. Specifically, a quantity of the same were installed on the doors of a motel chain (Holiday Inn) for test purposes. Many of the plastic hinges cracked as the screws were being tightened at the time of installation and the balance thereof cracked under normal use conditions a very brief period of time.

There is a clear need for a durable plastic hinge, but none appears in the prior art.

SUMMARY OF THE INVENTION

The longstanding but heretofore unfulfilled need for a plastic hinge that can be used as a replacement for metallic hinges is now provided in the form of an injection molded hinge that has been subjected to stress tests and found durable. More particularly, the hinge disclosed herein was installed on a door and did not crack when the fastening screws were tightened as had the plastic hinges of the prior art. A two hundred fifth pound (250#) individual applied his weight to the door on the side opposite the hinge and the hinge continued to function without cracking.

The composition of the hinge of this invention is a plastic material known as glass filled nylon. The hinge pin of this invention is a plastic material known as Delron (trademark). A hinge formed of these two (2) materials overcomes the limitations of the prior art and can be produced in great quantity by the injection molding process and thus can be manufactured at low cost.

It is therefore seen that the primary object of this invention is to provide a non-metallic hinge that is nevertheless as strong as metallic hinges.

A more specific purpose is to provide a plastic hinge having a composition that produces a non-brittle, self-lubricating hinge.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
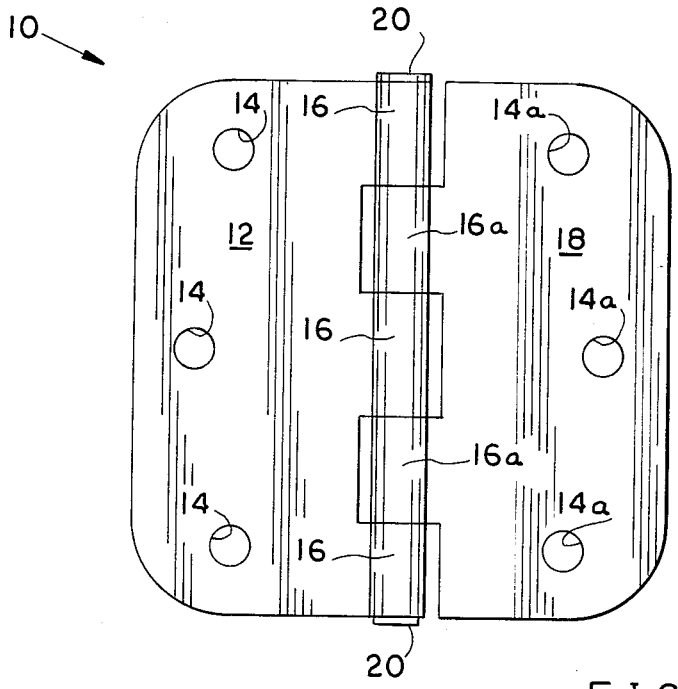
FIG. 1 is a front elevational view of the plastic hinge of this invention.
Figure 2:
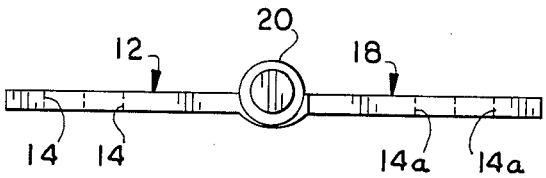
FIG. 2 is a top plan view thereof.

Referring now to FIG. 1, it will there be seen that the novel hinge is denoted generally by the reference numeral 10. The hinge 10 includes flat base plate 12 that is apertured as at 14 and which is secured to a door jamb by screws (not shown) extending through said apertures. A plurality of vertically and equidistantly spaced truncate cylindrical members 16 are integrally formed with plate 12 in the well known manner.

Door-mounted plate member 18 is similarly apertured as at 14*a* and includes truncate cylindrical members 16*a* that are cooperatively positioned relative to the members 16 so that a continuous bore means is thereby defined in the well known manner.

A hinge pin 20 is slideably disposed within the bore means and serves to yoke the truncate cylindrical members 16, 16*a* to one another. When a hingedly mounted door is opened or closed, the cylindrical members 16*a* will rotate about an axis defined by the bore means or the hinge pin 20, it being understood that the hinge pin 20 does not rotate. Thus, frictional rubbing occurs between the hinge pin 20 and the inner cylindrical side walls of the cylindrical members 16*a*, and it is this relative movement that requires the use of lubricants in metallic hinges.

The novel hinge 10 is formed of fifty percent (50%) glass filled plasticized nylon, and the novel hinge pin 20 is formed of twenty percent (20%) glass filled Delron (trademark). The Delron hinge pin 20 is self-lubricating and as a result the hinge 10 need never be oiled or otherwise lubricated. However, plates 12 and 18 may not be formed of Delron as it is too brittle for such use.

The glass filled nylon employed should be of virgin materials, as it has been found that "re-cycled" glass filled nylon has unacceptable qualities. Moreover, the 50% composition of fiberglass is quite critical, as it has been found that a hinge made of thirty percent (30%) glass filled nylon is unacceptable. Moreover, the fifty percent (50%) composition represents a somewhat critical upper limit as well in that hinges having greater than 50% glass composition are overly abrasive and are not easily worked with.

Injection molding is the preferred method or technique for producing the novel hinge, although the same could be made by other methods.

The total composition of the subject hinge is best understood as a mixture in substantially equal parts of plasticized nylon and fiberglass filled nylon. The total composition of the hinge pin being 80% plasticized nylon and 20% glass filled nylon.

It will thus be seen that the objects set forth above, and those made apparent by the foregoing description, are efficiently attained, and since certain changes may be made in the above construction without departing from the scope of the invention, it is intended that all matters contained in the foregoing description, or shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

That which is claimed is:

1. A hinge member formed of plastic, wherein the improvement comprises:

a hinge body member formed of plasticized nylon and glass filled nylon;

said hinge body member formed of fifty percent plasticized nylon;

said hinge body member formed of fifty percent glass filled nylon;

a hinge pin member;

said hinge pin member formed of plasticized nylon and glass filled nylon;

said hinge pin member formed of eighty percent plasticized nylon;

said hinge pin member formed of twenty percent glass filled nylon;

said glass filled nylon of which said hinge body member and said hinge pin member are formed, at least in part, including virgin or non-recycled glass filled nylon only.

* * * * *